US008911291B2

(12) United States Patent
Liu

(10) Patent No.: US 8,911,291 B2
(45) Date of Patent: Dec. 16, 2014

(54) DISPLAY SYSTEM AND DISPLAY METHOD FOR VIDEO WALL

(71) Applicant: VIA Technologies, Inc., New Taipei (TW)

(72) Inventor: Steve Shu Liu, New Taipei (TW)

(73) Assignee: VIA Technologies, Inc., New Taipei (TW)

( * ) Notice: Subject to any disclaimer, the term of this patent is extended or adjusted under 35 U.S.C. 154(b) by 0 days.

(21) Appl. No.: 13/685,617

(22) Filed: Nov. 26, 2012

(65) Prior Publication Data

US 2014/0094300 A1 Apr. 3, 2014

(30) Foreign Application Priority Data

Sep. 28, 2012 (CN) ..... 2012 1 0370806

(51) Int. Cl.
*A63F 9/24* (2006.01)

(52) U.S. Cl.
USPC ..... 463/25; 348/14.1

(58) Field of Classification Search
USPC ..... 463/16, 25, 31–42; 348/14.1
See application file for complete search history.

(56) References Cited

U.S. PATENT DOCUMENTS

| | | | | |
|---|---|---|---|---|
| 2009/0124385 | A1* | 5/2009 | Cuddy et al. | 463/42 |
| 2010/0035674 | A1* | 2/2010 | Slomiany et al. | 463/9 |
| 2011/0122063 | A1* | 5/2011 | Perlman et al. | 345/161 |
| 2011/0269534 | A1* | 11/2011 | Kelly et al. | 463/25 |
| 2012/0004747 | A1* | 1/2012 | Kelly et al. | 700/91 |
| 2012/0069131 | A1* | 3/2012 | Abelow | 348/14.01 |
| 2013/0040719 | A1* | 2/2013 | Fujisawa et al. | 463/16 |

* cited by examiner

*Primary Examiner* — Masud Ahmed
(74) *Attorney, Agent, or Firm* — Jianq Chyun IP Office

(57) ABSTRACT

A display system and a display method for video walls are provided. The display system includes at least one server and a plurality of player devices. Each server renders an image and transmits the image to a network. The player devices are coupled to the at least one server through the network. Each player device receives the image or a part of the image rendered by one of the at least one server, and determines a synchronization time together with at least one of the other player devices. Each player device uses a display of a video wall to simultaneously display the image or the part of the image at the synchronization time.

9 Claims, 8 Drawing Sheets

DISPLAY SYSTEM AND DISPLAY METHOD FOR VIDEO WALL

CROSS-REFERENCE TO RELATED APPLICATION

This application claims the priority benefit of China application serial no. 201210370806.0, filed on Sep. 28, 2012. The entirety of the above-mentioned patent application is hereby incorporated by reference herein and made a part of this specification.

BACKGROUND

1. Field of the Invention

The invention relates to a display system and a display method, and more particularly to, a display system and a display method for video walls.

2. Description of Related Art

A video wall is namely a large display device composed by a plurality of displays via splicing method, and may adapted to be used in a control room, a video conference, or as an indoor/outdoor large billboard.

Conventional methods for the video wall are mostly using a plurality of servers with ×86 frameworks to provide an image displayed by video wall. Each server may use a graphics card of multiple outputs to concurrently connect to the plurality of displays of the video wall through single transmission lines of High-Definition Multimedia Interface (HDMI) or Digital Visual Interface (DVI), or use a plurality of graphics cards to concurrently connect to the plurality of displays of the video wall. The conventional methods are less flexible and are also limited by lengths of the signal transmission lines.

SUMMARY OF THE INVENTION

The invention provides a display system and a display method for video walls, so as to enhance application flexibilities of the video walls and to lift a length limitation of a signal transmission line.

The invention provides a display system for a video wall including at least one server and a plurality of player devices. Each server renders an image and transmits the image to a network. The plurality of player devices is coupled to the server through the network. Each player device received an image or a part of the image rendered by one of the server from the network, and determines a synchronization time together with at least one of the other player devices. Each player device respectively uses a display of the video wall to simultaneously display the image or the part of the image at the synchronization time.

The invention further provides a display method for a video wall including the following steps. At least one image is rendered. The image is transmitted to a network. The image is received from the network. A synchronization time is determined. At the synchronization time, a plurality of displays of the video wall is used to simultaneously display the image.

According to the foregoing, the invention uses the network as a medium for transmitting the image between the server and the player devices, and as long as the network exists, the player devices and video wall may be set up. Hence, a distance between the server and the video wall is not restricted by the length limitation of signal transmission line, and may increase or decrease an amount of the server, the player device or the display depending on application requirements, thus achieving a great flexibility in application.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
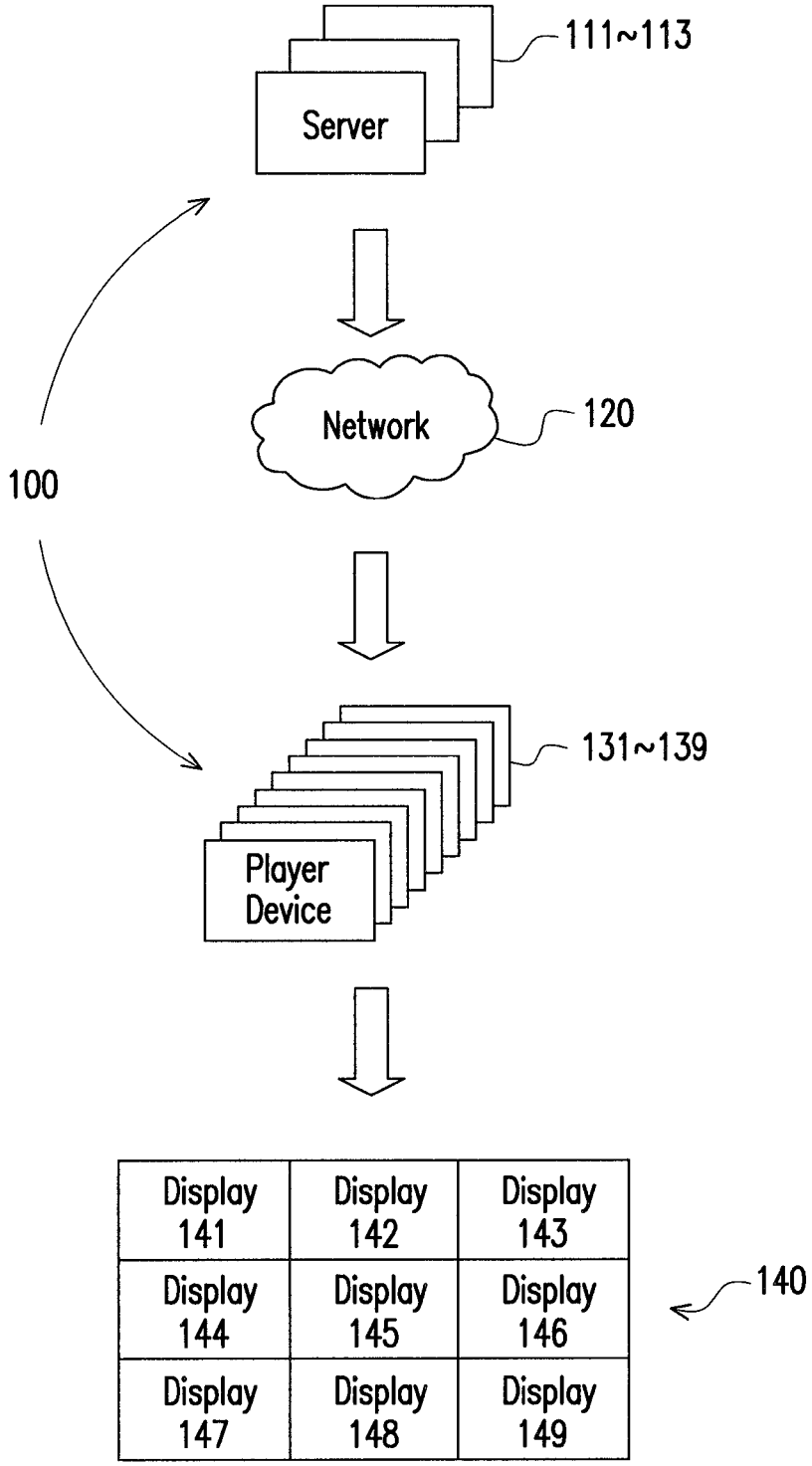
FIG. 1A is a schematic diagram illustrating a display system according to an embodiment of the invention.

FIG. 1A is a schematic diagram illustrating a display system 100 according to an embodiment of the invention. The display system 100 of the invention may include at least one server and any amount of player device. In the present embodiment, the display system 100 includes three servers 111 to 113 and nine player devices 131 to 139. Wherein, the servers 111 to 113 each renders an image and transmits the image to a network 120. The network 120 may be a wired network or a wireless network, may be an Internet or a local area network, but the invention is not limited thereto.

The nine player devices 131 to 139 are coupled to the three servers 111 to 113 through the network 120. Wherein, each player device in the nine player devices 131 to 139 may receive a part of the image rendered by one of the servers 111 to 113 from the network 120. Afterward, each of the player devices 131 to 139 determines a synchronization time together with at least one of the other player devices, and respectively uses one of a plurality of displays 141 to 149 of a video wall 140 to display the part of image received from the network 120 at this synchronization time.

Figure 1B:
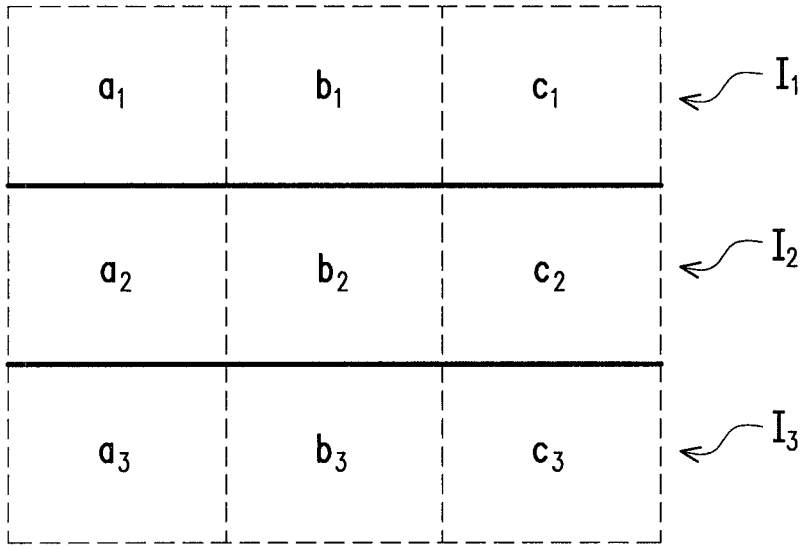
FIG. 1B is a schematic diagram illustrating a remote server virtual image segmentation method according to an embodiment of the invention.

In more detail, as shown in FIG. 1B, the server 111 may render an image I1, segment the image I1 into three parts a1, b1 and c1, and transmit the three parts a1, b1 and c1 to the network 120 after encoding; these three parts may be respectively received by the player devices 131 to 133 and displayed at the displays 141 to 143 after going through decoding and simultaneous processing. Similarly, the server 112 may render another image I2, segment the image I2 into three parts a2, b2 and c2 and transmit three parts a2, b2 and c2 to the network 120 after encoding; these three parts may be respectively received by the player devices 134 to 136 and displayed at the displays 144 to 146 after decoding and simultaneously processing. Similarly, the server 113 may render another image I3, segment the image I3 into three parts a3, b3 and c3, and transmit the three parts a3, b3 and c3 to the network 120 after encoding; these three parts may be respectively received by the player devices 137 to 139 and displayed at the displays 147 to 149 after decoding and simultaneously processing. As such, after going through rendering, segmenting, encoding, and network transmitting by the remote server, and being received and simultaneously processed by the player devices, the video wall 140 may display the images I1, I2 and I3 at the same time; namely, the screen image displayed by the video wall 140 is composed of the images I1, I2 and I3 rendered by the servers 111 to 113.

Figure 2:
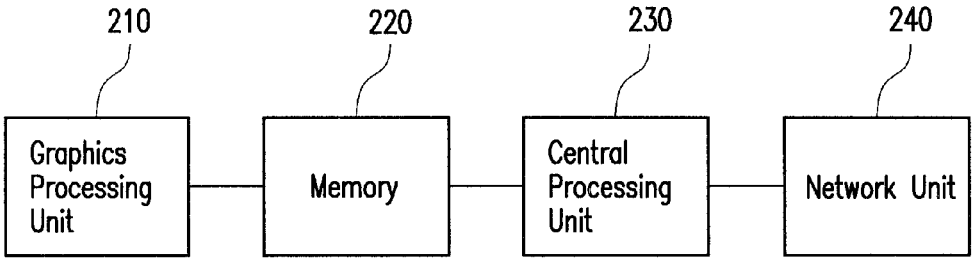
FIG. 2 is a schematic diagram illustrating a server according to an embodiment of the invention.

Structures of the servers 111 to 113 are the same, as shown in FIG. 2, each of the servers 111 to 113 includes a graphics processing unit (GPU) 210, a memory 220, a central processing unit (CPU) 230, and a network unit 240 coupled in series. The network unit 240 is also coupled to the network 120. The graphics processing unit 210, the memory 220, the central processing unit 230, and the network unit 240 are all composed of hardware circuits.

Figure 3:
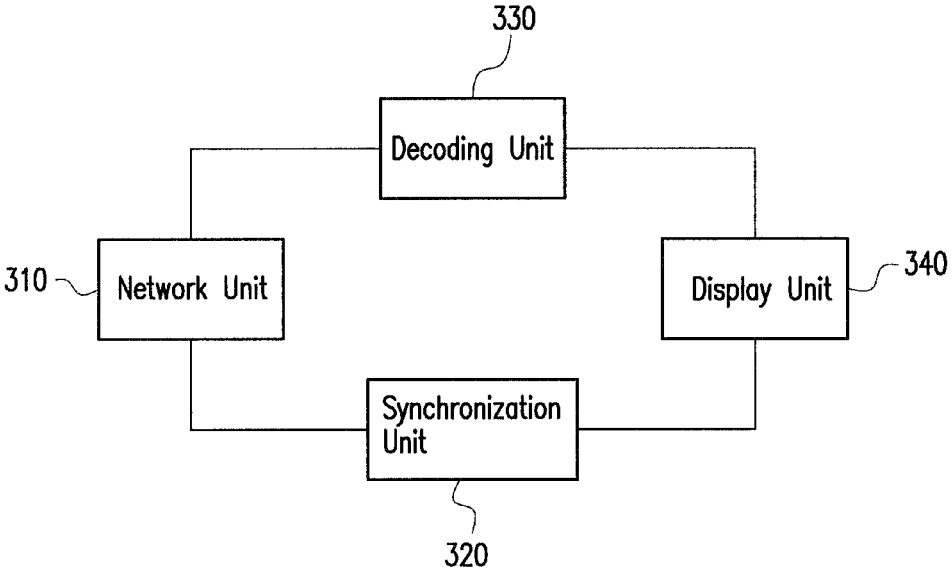
FIG. 3 is a schematic diagram illustrating a player device according to an embodiment of the invention.

Structures of the player devices 131 to 139 are the same, as shown in FIG. 3, each of the player devices 131 to 139 includes a network unit 310, a synchronization unit 320, a decoding unit 330, and a display unit 340. The network unit 310 is coupled to the servers 111 to 113 through the network 120, the synchronization unit 320 and the decoding unit 330 are both coupled to the network unit 310, and the display unit 340 is coupled to the synchronization unit 320 and the decoding unit 330. The network unit 310, the synchronization unit 320, the decoding unit 330, and the display unit 340 are all composed of hardware circuits.

Figure 4:
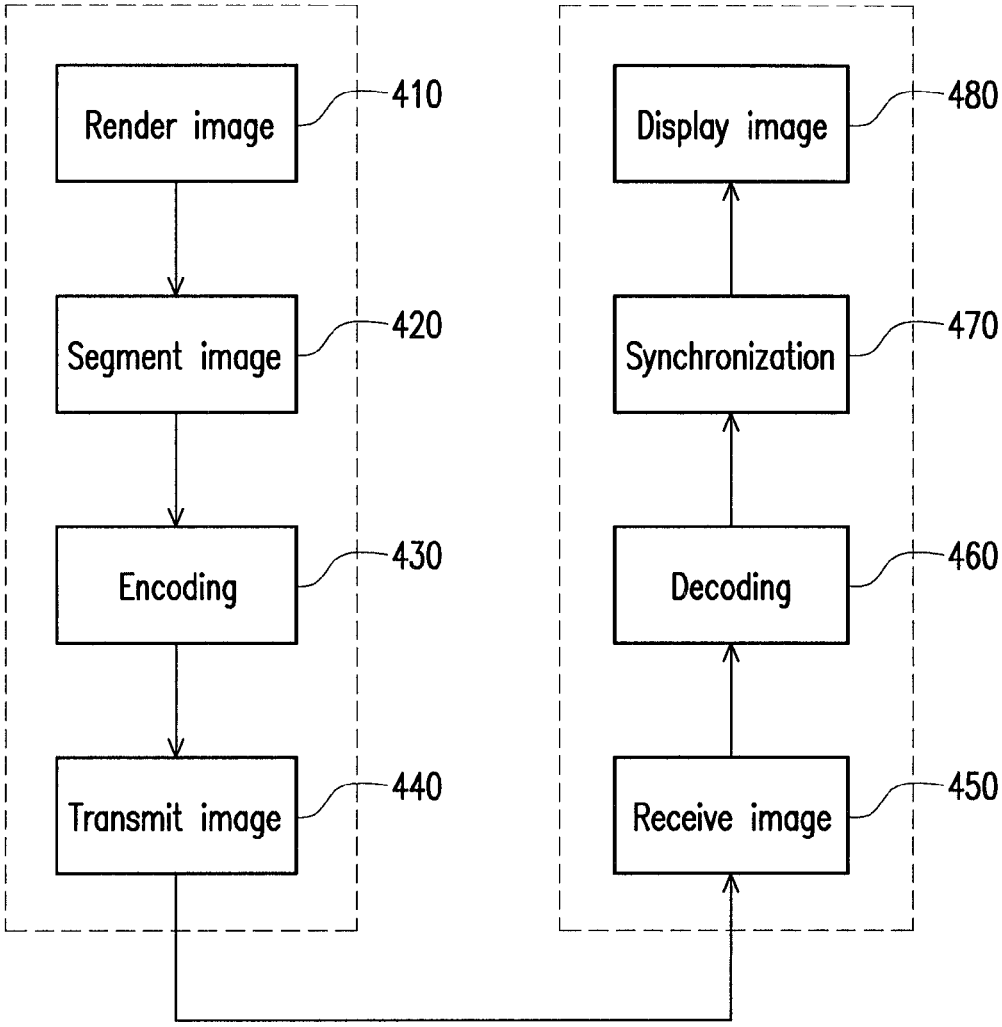
FIG. 4 is a flow chart diagram illustrating a display method according to an embodiment of the invention.

FIG. 4 is a flow chart diagram illustrating a display method according to an embodiment of the invention. The method may be executed by the servers 111 to 113 and the player devices 131 to 139 in parallel, wherein steps 410 to 440 are executed by the servers 111 to 113, and steps 450 to 480 are executed by the player devices 131 to 139.

Firstly, in step 410, the graphics processing unit 210 renders an image and stores the image into the memory 220. The image may be a two-dimensional image, a three dimensional image, an image obtained by video decoding, or a combination thereof. In step 420, the central processing unit 230 segments the image rendered by the graphics processing unit 210 into a plurality of parts; in the present embodiment, the image is segmented into three parts. In step 430, the central processing unit 230 encodes each segmented image part.

The above-mentioned encoding may compress the image for saving network bandwidths or encrypt the image for protecting contents therein, and may also simultaneously perform the compression and the encryption. The central processing unit 230 may include a plurality of processors or a plurality of processing cores, and these processors or processing cores may execute steps 420 and 430 in parallel so as to enhance efficiency.

Then, in step 440, the network unit 240 transmits each part of the image, which is segmented and encoded by the central processing unit 230, to the network 120.

Next, in step 450, the network unit 310 receives every part of the image from the network 120. Each part of the image is received by one of the network unit 310 in the player devices 131 to 139. In step 460, the decoding unit 330 decodes the part of the image received by the network unit 310. The above-mentioned decoding is corresponding to the encoding of the central processing unit 230, and restores the image back to the original image before the encoding.

In step 470, the synchronization unit 320 determines a synchronization time together with the synchronization unit 320 of at least one of the other player devices through the network unit 310. The synchronization units 320 of the player devices 131 to 139 may use any conventional synchronization mechanism, through the network 120 to transmit signals with each other, to determine the synchronization time. In step 480, the display unit 340 of each of the player devices 131 to 139 respectively uses one of the displays 141 to 149 of the video wall 140 at the synchronization time, and simultaneously displays the part of the image restored by the decoding unit 330. The synchronization time may be determined by the player devices 131 to 139 together, and therefore, the displays 141 to 149 simultaneously display the image I1, I2 and I3 rendered by the servers 111 to 113 at the synchronization time, so that the confusion due to uncoordinated display timings from each player device may be avoided.

Figure 5:
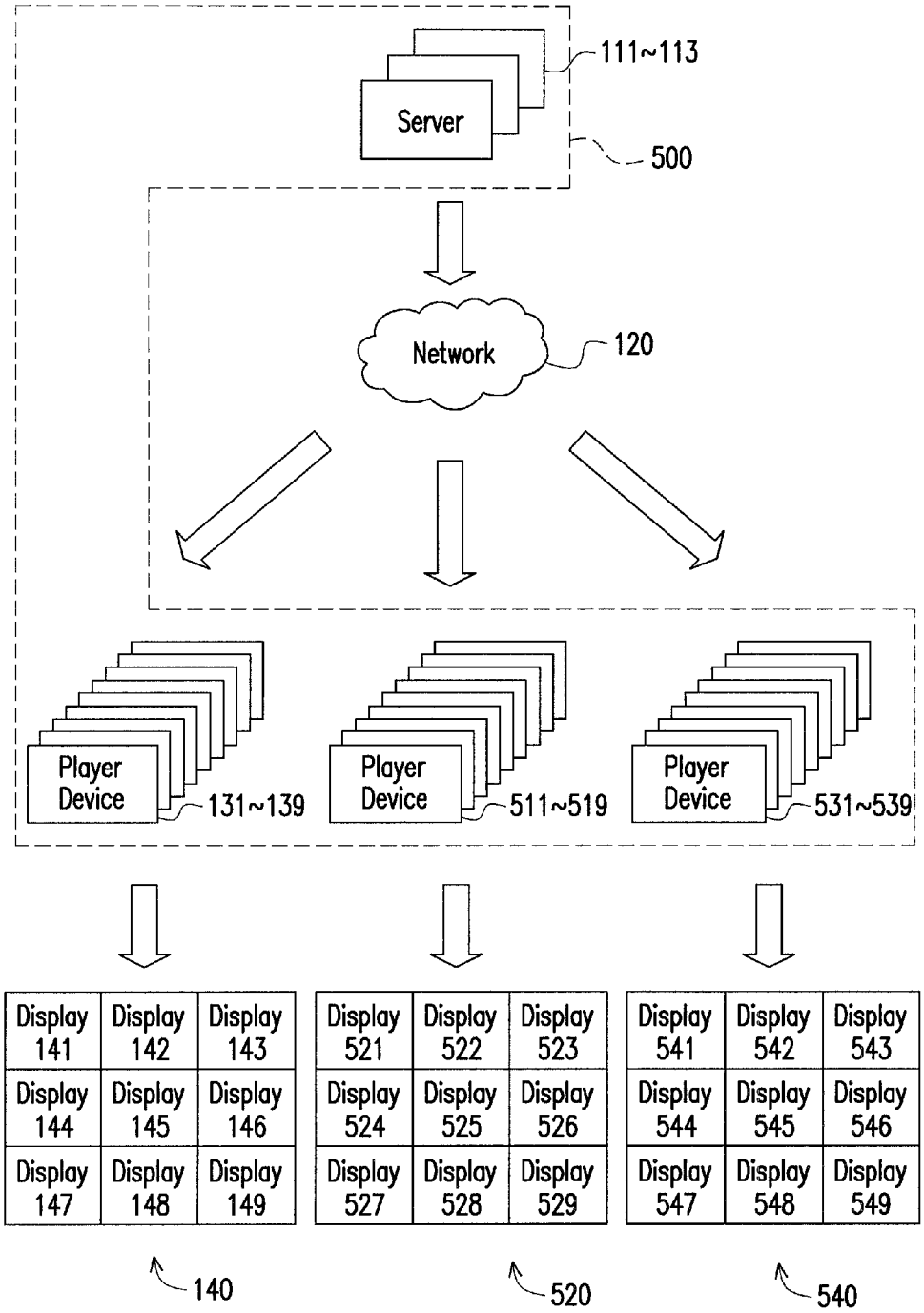
FIG. 5 is a schematic diagram illustrating a display system according to another embodiment of the invention.

The display system of the invention may include a plurality of player device sets, each player device set may respectively includes a plurality of player devices, and each player device may respectively be coupled to a video wall; for example, FIG. 5 is a schematic diagram illustrating a display system 500 according to another embodiment of the invention. The display system 500 includes servers 111 to 113 and three player device sets, namely, the player devices 131 to 139, 511 to 519 and 531 to 539. The player devices 131 to 139, 511 to 519 and 531 to 539 are respectively coupled to the video walls 140, 520 and 540. The video walls 140, 520 and 540 may display the same image, and the video walls 140, 520 and 540 may be disposed at a same location or different locations as the corresponding player devices thereof.

As described in above, the server 111 may render the image I1, segment the image I1 into three parts, and transmit the segmented parts to the network 120. The player devices 131 to 133 may respectively receive the three parts of the image I1, and respectively display these three parts at the displays 141 to 143. The player devices 511 to 513 may respectively receive the three parts of the image I1, and respectively display these three parts at the displays 521 to 523. The player devices 531 to 533 may respectively receive the three parts of the image I1, and respectively display these three parts at the displays 541 to 543.

The server 112 may render the image I2, segment the image I2 into three parts, and transmit the three parts to the network 120. The player devices 134 to 136 may respectively receive the three parts of the image I2, and respectively display these three parts at the displays 144 to 146. The player devices 514 to 516 may respectively receive the three parts of the image I2, and respectively display these three parts at the displays 524 to 526. The player devices 534 to 536 may respectively receive the three parts of the image I2, and respectively display these three parts at the displays 544 to 546.

The server 113 may render the image I3, segment the image I3 into three parts, and transmits these three parts to the network 120. The player devices 137 to 139 may respectively receive the three parts of the image I3, and respectively display these three parts at the displays 147 to 149. The player devices 517 to 519 may respectively receive the three parts of the image I3, and respectively display these three parts at the displays 527 to 529. The player devices 537 to 539 may respectively receive the three parts of the image I3, and respectively display these three parts at the displays 547 to 549.

The player devices 131 to 139, 511 to 519 and 531 to 539 and the video walls 140, 520 and 540 may be disposed at the same location. In this situation, the synchronization time of each player device of the player devices 131 to 139, 511 to 519 and 531 to 539 used for displaying the images may be determined by all the player devices 131 to 139, 511 to 519 and 531 to 539 together. Namely, the images displayed by the video walls 140, 520 and 540 may be fully synchronized.

Another situation is that each video wall and the corresponding player devices may respectively be disposed at different locations. For example, the player devices 131 to 139 and the video wall 140 may be disposed at a first location, the player devices 511 to 519 and the video wall 520 may be disposed at a second location, and the player devices 531 to 539 and the video wall 540 may be disposed at a third location. In this situation, the synchronization time of each player device used for displaying the images may be determined together with the other player devices corresponding to the same video wall. Namely, the player devices 131 to 139 may together determine a synchronization time T1, the player devices 511 to 519 may together determine a synchronization time T2, and the player devices 531 to 539 may together determine a synchronization time T3. T1, T2 and T3 may be the same or may be different. As such, the synchronization time corresponding to each display is the same as the other displays of the same video wall.

Figure 6:
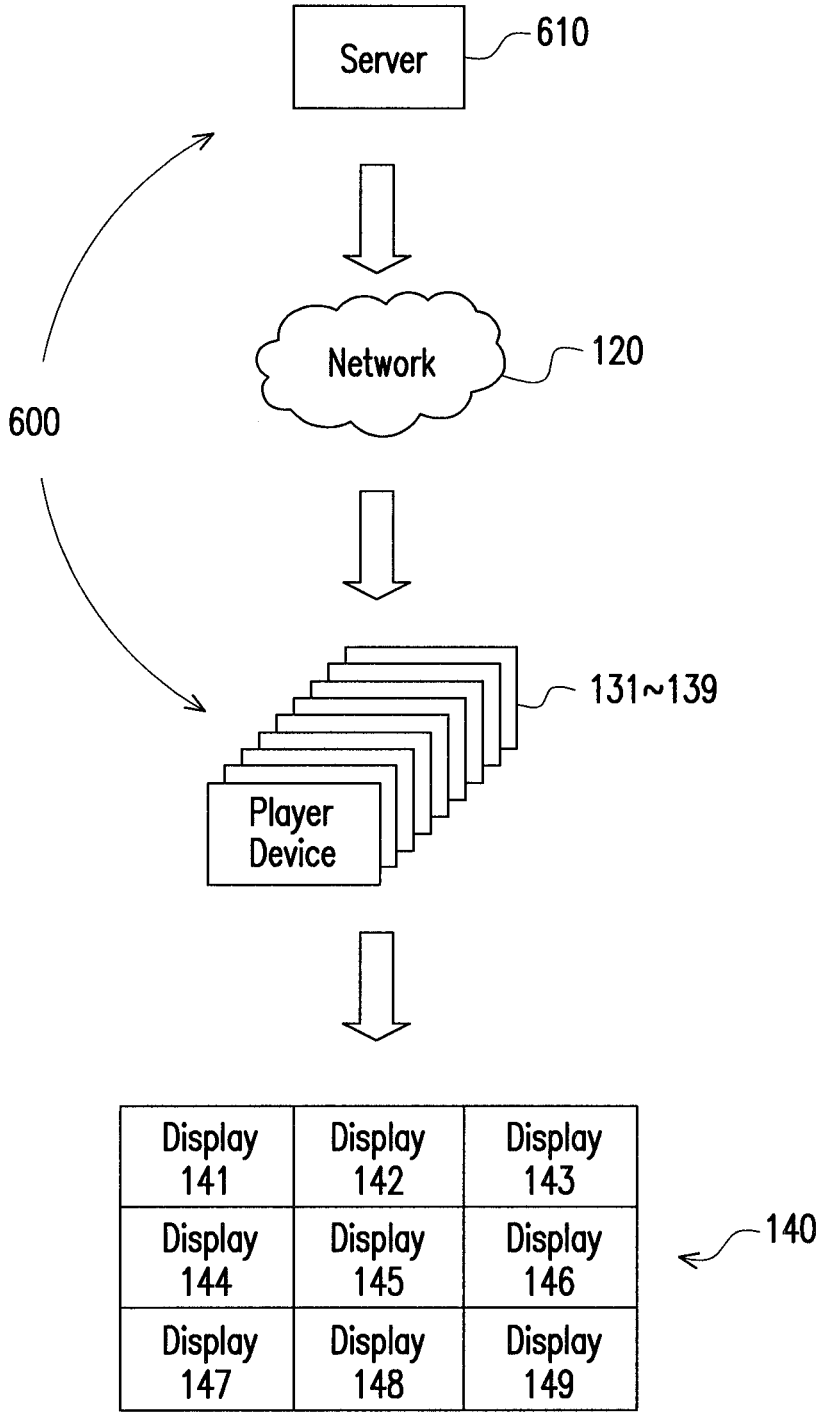
FIG. 6 is a schematic diagram illustrating a display system according to another embodiment of the invention.

The display systems of the above-mentioned embodiments all include a plurality of servers, but the invention is not limited thereto. The display system of the invention may also include only a single server; for example, FIG. 6 is a schematic diagram illustrating a display system 600 according to another embodiment of the invention. The display system 600 includes a server 610 and the player devices 131 to 139. The server 610 may render an image, segment the image into nine parts, and transmit these nine parts to the network 120; these nine parts may respectively be received by the player devices 131 to 139, and respectively be displayed at the displays 141 to 149.

Figure 7:
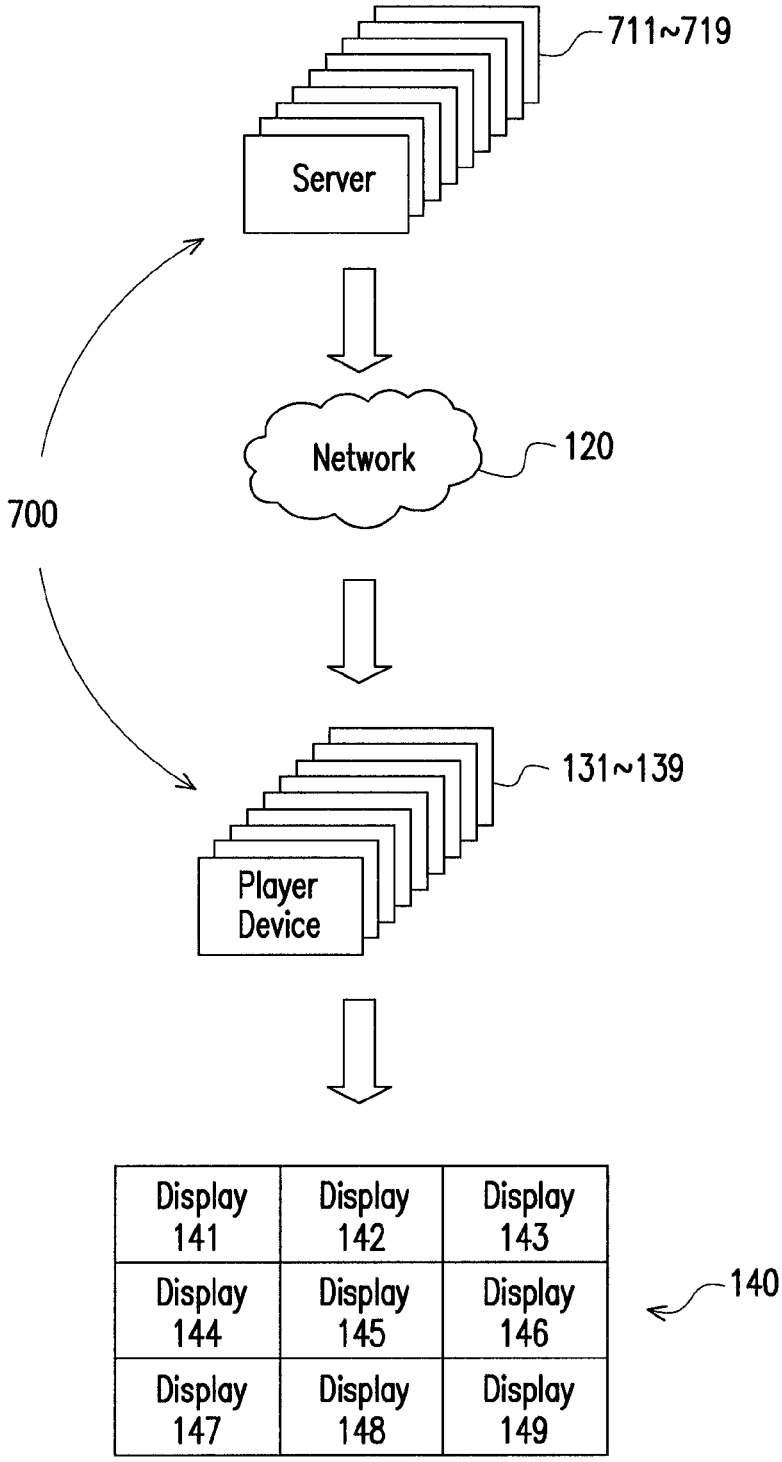
FIG. 7 is a schematic diagram illustrating a display system according to another embodiment of the invention.

Some embodiments of the invention may omit the step 420 in the method illustrated in FIG. 4, and in this situation, amounts of the server and the player device must be equal; for example, FIG. 7 is a schematic diagram illustrating a display system 700 according to another embodiment of the invention. The display system 700 includes servers 711 to 719 and the player devices 131 to 139. The servers 711 to 719 may respectively render nine images I1 to I9 and respectively transmit the images I1 to I9 to the network 120. The images I1 to I9 may respectively be received by the player devices 131 to 139, and respectively be displayed by at the displays 141 to 149. In this kind of embodiment, the central processing unit 230 of each server does not segment the image rendered by the graphics processing unit, but only encode the image. The network unit 240 transmits the unsegmented complete image to the network 120. The network unit 310 of each of the player devices 131 to 139 receives the unsegmented complete image from the network 120, namely, one of the images I1 to I9. The decoding unit 330 decodes the complete image, and the display unit 340 uses one of the displays 141 to 149 to display the unsegmented complete image.

Figure 8:
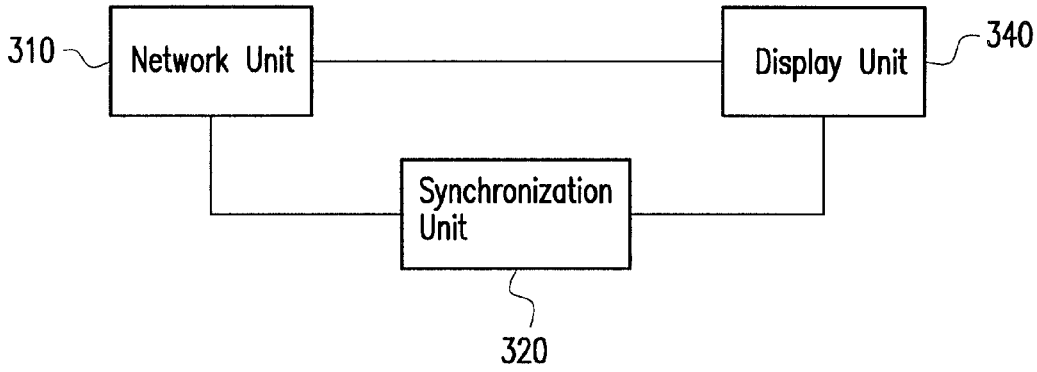
FIG. 8 is a schematic diagram illustrating a player device system according to still another embodiment of the invention.

The embodiments of FIG. 1A, FIG. 5 and FIG. 6 may omit the steps 430 and 460 in the method illustrated in FIG. 4. In this situation, the central processing unit 230 of each server only segments the image rendered by the graphics processing unit 210 render while not performing the encoding, and the network unit 240 transmit the non-encoded part of the image to the network 120. Each player device may omit the decoding unit 330, as shown in FIG. 8. In this kind of embodiment, the display unit 340 is coupled to the network unit 310, and directly displays the part of the image received by the network unit 310.

Figure 9:
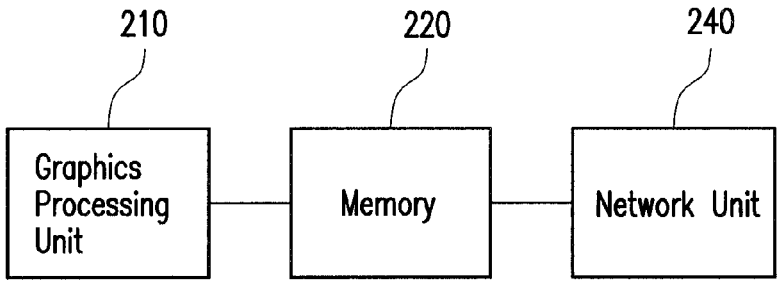
FIG. 9 is a schematic diagram illustrating a server according to still another embodiment of the invention.

The embodiment of FIG. 7, in addition to omitting the step 420 in the method illustrated in FIG. 4, may also omit the steps 430 and 460. In this situation, each server may omit the central processing unit 230, as shown in FIG. 9. In this kind of embodiment, the network unit 240 of each server may directly transmit the image rendered by the graphics processing unit 210 to the network 120.

In the above respective embodiments, the graphics processing unit 210 of each server may render the image according to a preset resolution and refresh rate, so as to provide to the video wall for display. When a bandwidth of the network 120 is insufficient, a pixel amount corresponding to the resolution may be set with a relationship that is inversely proportional to the refresh rate. For example, when displaying on a 3D game screen, the refresh rate may be kept high while the pixel amount of the resolution may be reduced. When displaying a static document, the pixel amount of the resolution may be enhanced while the refresh rate may be reduced.

In summary, in the invention, with the popularity and remote features of the network, a distance between the video walls and the server for providing the image may be lengthened, and a configuration flexibility of the video walls may be enhanced. When deploying the video walls, only the video walls and the player devices are required to be moved, the server is not required to be moved, and the distance between the video walls and the server is not limited by a length of a traditional signal transmission line. The display system of the invention has a high scalability, may add servers to render a more complicated image or an image of higher resolution depending on the application requirements, and may also add play devices to connect more displays. The display system of the invention may also uses the parallel processing capability of the server to enhance the efficiency. The image rendered by the same set of servers may simultaneously be provided to a plurality of video walls, and thus may reduce the amount of servers and lower the costs. The display system and the display method of the invention may also flexibly adjust the resolution and the refresh rate for providing a favorable display quality.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display system for a video wall, comprising:

at least one server, wherein each said server renders an image, encrypts the image, and transmits the image to a network; and a plurality of player devices coupled to the at least one server through the network, wherein each said player device receives the image or a part of the image rendered by one of the at least one server from the network, decrypts the image or the part of the image, and determines a synchronization time together with at least one of the other player devices, and each said player device respectively uses a display of the video wall to simultaneously display the image or the part of the image at the synchronization time, wherein each said server comprises:

a memory;

a graphics processing unit coupled to the memory, rendering the image and storing the image into the memory;

a central processing unit coupled to the memory, encrypting the image rendered by the graphics processing unit; and a first network unit coupled between the central processing unit and the network, and transmitting the encrypted image to the network;

and each said player device comprises:

a second network unit coupled to the at least one server through the network, and receiving the image or the part of the image from the network;

a synchronization unit coupled to the second network unit, and determining the synchronization time together with a synchronization unit of the at least one of the other player devices through the second network unit;

a decoding unit coupled to the second network unit, decrypting the image or the part of the image received by the second network unit; and a display unit coupled to the decoding unit and the synchronization unit, and using the display of the video wall to display the decrypted image or the decrypted part of the image at the synchronization time.

2. The display system for the video wall as recited in claim 1, wherein the images of the plurality of player devices are displayed in at least one video wall, and the synchronization time of each said player device is determined by all the player devices together.

3. The display system for the video wall as recited in claim 1, wherein the images of the plurality of player devices are displayed in at least one video wall, and the synchronization time of each said player device is determined with the other player devices corresponding to the same video wall together.

4. The display system for the video wall as recited in claim 1, wherein the central processing unit segments the image rendered by the graphics processing unit into a plurality of parts, wherein the first network unit transmits the plurality of parts to the network, and each said part is received by one of the player devices.

5. The display system for the video wall as recited in claim 1, wherein the graphics processing unit renders the image according to a resolution and a refresh rate, and a pixel amount corresponding to the resolution is inversely proportional to the refresh rate.

6. A display method for a video wall, executed by at least one server and a plurality of player devices coupled through a network, the display method comprising:

the at least one server rendering at least one image;

the at least one server segmenting each said image into a plurality of parts;

the at least one server encrypting the parts of the at least one image;

the at least one server transmitting the encrypted parts of the at least one image to the network;

the player devices receiving the encrypted parts of the at least one image from the network;

the player devices decrypting the encrypted parts of the at least one image;

the player devices determining a synchronization time; and the player devices using a plurality of displays of the video wall to simultaneously display the at least one image at the synchronization time.

7. The display method for the video wall as recited in claim 6, wherein the at least one image are displayed on at least one video wall, and the synchronization time corresponding to each display of each said video wall is the same.

8. The display method for the video wall as recited in claim 6, wherein the at least one image are display on at least one video wall, and the synchronization time corresponding to each display of the at least one video wall is the same as that of the other displays of the same video wall.

9. The display method for the video wall as recited in claim 6, further comprising:

the at least one server rendering the at least one image according to a resolution and a refresh rate, wherein a pixel amount corresponding to the resolution is inversely proportional to the refresh rate.

* * * * *